US007177534B2

(12) United States Patent
Jones et al.

(10) Patent No.: US 7,177,534 B2
(45) Date of Patent: Feb. 13, 2007

(54) SYSTEM AND METHOD FOR CONTROLLING HEATING AND VENTILATING SYSTEMS

(75) Inventors: Gordon Jones, Plano, TX (US); Dan Int-hout, Plano, TX (US)

(73) Assignee: Air System Components, L.P., Richardson, TX (US)

( * ) Notice: Subject to any disclaimer, the term of this patent is extended or adjusted under 35 U.S.C. 154(b) by 57 days.

(21) Appl. No.: 10/911,045

(22) Filed: Aug. 4, 2004

(65) Prior Publication Data

US 2005/0082277 A1 Apr. 21, 2005

Related U.S. Application Data

(60) Provisional application No. 60/503,782, filed on Sep. 17, 2003.

(51) Int. Cl.
*F24H 3/02* (2006.01)

(52) U.S. Cl. ..... 392/360; 219/501; 219/494

(58) Field of Classification Search ..... 392/360–369, 392/379–385; 700/300; 165/247, 253, 256, 165/259, 269; 219/492, 501, 494
See application file for complete search history.

(56) References Cited

U.S. PATENT DOCUMENTS

| | | | | |
|---|---|---|---|---|
| 2,398,673 | A | | 4/1946 | Schneider |
| 2,498,054 | A | | 2/1950 | Taylor |
| 3,525,851 | A | | 8/1970 | Seabury, Jr. |
| 3,735,148 | A | | 5/1973 | Sapir |
| 4,302,663 | A | * | 11/1981 | Chesnut et al. ..... 219/497 |
| 4,442,972 | A | | 4/1984 | Sahay et al. |
| 4,482,092 | A | | 11/1984 | Biber et al. |
| 4,642,441 | A | * | 2/1987 | Kenyon ..... 392/365 |
| 4,648,551 | A | | 3/1987 | Thompson et al. |
| 4,941,525 | A | | 7/1990 | Ito et al. |
| 5,325,286 | A | | 6/1994 | Weng et al. |
| 5,410,230 | A | | 4/1995 | Bessler et al. |
| 5,434,946 | A | * | 7/1995 | Barzilai et al. ..... 392/385 |
| 5,488,218 | A | | 1/1996 | Olsen et al. |
| 5,492,273 | A | | 2/1996 | Shah |

(Continued)

FOREIGN PATENT DOCUMENTS

GB 2251681 * 7/1992

(Continued)

*Primary Examiner*—Thor S. Campbell
(74) *Attorney, Agent, or Firm*—Calfee, Halter & Griswold LLP

(57) ABSTRACT

A system and method for controlling a heating and ventilating system is provided. The method includes determining a demand for heat and creating an air flow. In addition, the method includes sensing an outlet discharge temperature of the air flow and increasing the temperature of the air flow to a selected value. Generally, the method further includes increasing the air flow velocity, while maintaining the discharge temperature of the air flow to the selected value. The system for controlling a heating and ventilating system includes an input for receiving a demand signal and a heater control circuitry for controlling the heat output of a heat source. In addition, the system includes ventilation control circuitry for controlling the flow of an air source and an outlet air temperature sensor. Finally, the system preferably includes a microcontroller for controlling the heat output and the flow of the air source.

33 Claims, 7 Drawing Sheets

U.S. PATENT DOCUMENTS

| | | | | | |
|---|---|---|---|---|---|
| 5,706,190 | A | | 1/1998 | Russ et al. | |
| 5,718,372 | A | | 2/1998 | Tishler | |
| 5,831,244 | A | * | 11/1998 | Springer, Jr. | 219/203 |
| 6,062,482 | A | | 5/2000 | Gauthier et al. | |
| 6,070,660 | A | | 6/2000 | Byrnes et al. | |
| 6,167,193 | A | * | 12/2000 | Birdsell et al. | 392/365 |
| 6,173,902 | B1 | | 1/2001 | Bauer et al. | |
| 6,329,783 | B1 | | 12/2001 | Vrionis et al. | |
| 6,491,094 | B2 | | 12/2002 | Rayburn et al. | |
| 6,665,492 | B1 | * | 12/2003 | Garcia et al. | 392/383 |
| 2002/0155405 | A1 | | 10/2002 | Casey et al. | |

FOREIGN PATENT DOCUMENTS

| | | | |
|---|---|---|---|
| JP | 62-202210 | * | 9/1987 |
| JP | 2-17022 | * | 1/1990 |
| JP | 6-205892 | * | 7/1994 |
| JP | 9-115647 | * | 5/1997 |
| JP | 10-162938 | * | 6/1998 |
| WO | 95/31915 | * | 11/1995 |

* cited by examiner

SYSTEM AND METHOD FOR CONTROLLING HEATING AND VENTILATING SYSTEMS

CROSS-REFERENCE TO RELATED APPLICATIONS

This application claims the benefits of and priority to U.S. Provisional Application No. 60/503,782 filed on Sep. 17, 2003, "System and Method for Controlling Heating and Ventilating Systems," which is hereby incorporated by reference in its entirety.

FIELD OF THE INVENTION

The present invention relates generally to heating and ventilating systems and, more particularly, to a system and method for controlling heating and ventilating systems.

BACKGROUND

Two common types of heating systems used in commercial and some residential buildings include staged heating systems and heating systems with multiple speed or variable speed blower motors. These heating, ventilating and cooling (HVAC) systems are governed by American Society for Heating, Refrigeration & Air conditioning Equipment, "ASHRAE" Standards. ASHRAE Standard 62 specifies the minimum ventilation rates and the minimum indoor air quality that is acceptable to human occupants. This standard is intended to minimize the potential for adverse health effects caused by inadequate ventilation rates which may result in poor indoor air quality. In addition, proposed addenda N of ASHRAE Standard 62 requires an increase in ventilation flow rate if the discharge temperature is too high, such as greater than 90° F.

Minimum ventilation rates governed by ASHRAE, include requirements for a minimum air flow velocity. One of those requirements is that the air flow velocity reach one-half of the way down an external wall, i.e. the air that is forced out of a duct along the ceiling and toward an external wall must travel at least one-half of the way down the external wall.

As noted above, some common heating and ventilating systems use staged heat controllers. Staged heat controllers typically employ a constant speed blower motor and add or subtract heating elements to maintain, increase, or decrease the amount of heat output into an area. Because staged heat controllers use a constant speed blower and do not limit the outlet air temperature, staged heat controllers are prone to problems, such as air stratification. Air stratification occurs when hot air stays along the ceiling or in one area, and is often a result of the discharge temperature being too high and the air velocity being too low. Hot air naturally rises so it takes a higher air flow velocity to force hot air to travel one-half way down the exterior wall than it takes to force cooler air to travel one-half way down the wall. As a result, hot air output from staged heat controllers often stratifies along the ceiling because the outlet air is too hot and the constant speed blower does not generate the necessary air flow velocity to force the air to travel half way down the exterior walls.

Heating and ventilating systems having multiple speed or variable speed ventilator/blower motors are also commonly used. In this type of system the controller typically ramps the speed of the motor up slowly while the heating element is first energized to minimize discomfort generated by forcing an initial blast of cold air into the space being heated. After the heating element is fully energized and is operating at its maximum heat output the motor runs at full speed. When the heating element is turned off, the variable speed motor speed slowly ramps down as the heating element cools. This process increases the efficiency of the heating system by extracting the remaining heat from the heating element. The heat output from these systems generally is not controlled and as a result, problems such as, for example, air stratification occur in these types of systems as well. In addition, the outlet temperature is often greater than a desired temperature, such as, for example, 90° F.

In addition, new construction materials, such as, exterior glass with improved thermal insulation characteristics and improved building insulation have created additional problems with the above controllers. The improved insulating qualities have reduced the demand for heat in new construction. The reduced demand for heat results in the heating and ventilating system needing to run for shorter periods of time to heat the building. Heating and ventilating systems, however, serve multiple purposes including both heating and ventilating. Inadequate ventilation and poor air quality occurs if the ventilation system is not run for long enough periods of time. As a result, staged heat controllers and typical multi-speed controllers do not provide adequate heating and ventilating control.

SUMMARY

A system and method for controlling a heating and ventilating system is provided. The method includes determining a demand for heat and creating an air flow. In addition, the method includes sensing an outlet discharge temperature of the air flow and increasing the temperature of the air flow to a selected value. In one exemplary embodiment, the method further includes increasing the air flow velocity, while maintaining the discharge temperature of the air flow at or near the selected value.

Generally, the inventive system for controlling a heating and ventilating system includes an input for receiving a demand signal and a heater control circuitry for controlling the heat output of a heat source and an outlet air temperature sensor. In one exemplary embodiment, the system includes ventilation control circuitry for controlling the flow of an air source. In addition, the system preferably includes a microcontroller for controlling the heat output and the flow of the air source.

DETAILED DESCRIPTION OF THE DRAWINGS

Figure 1A:
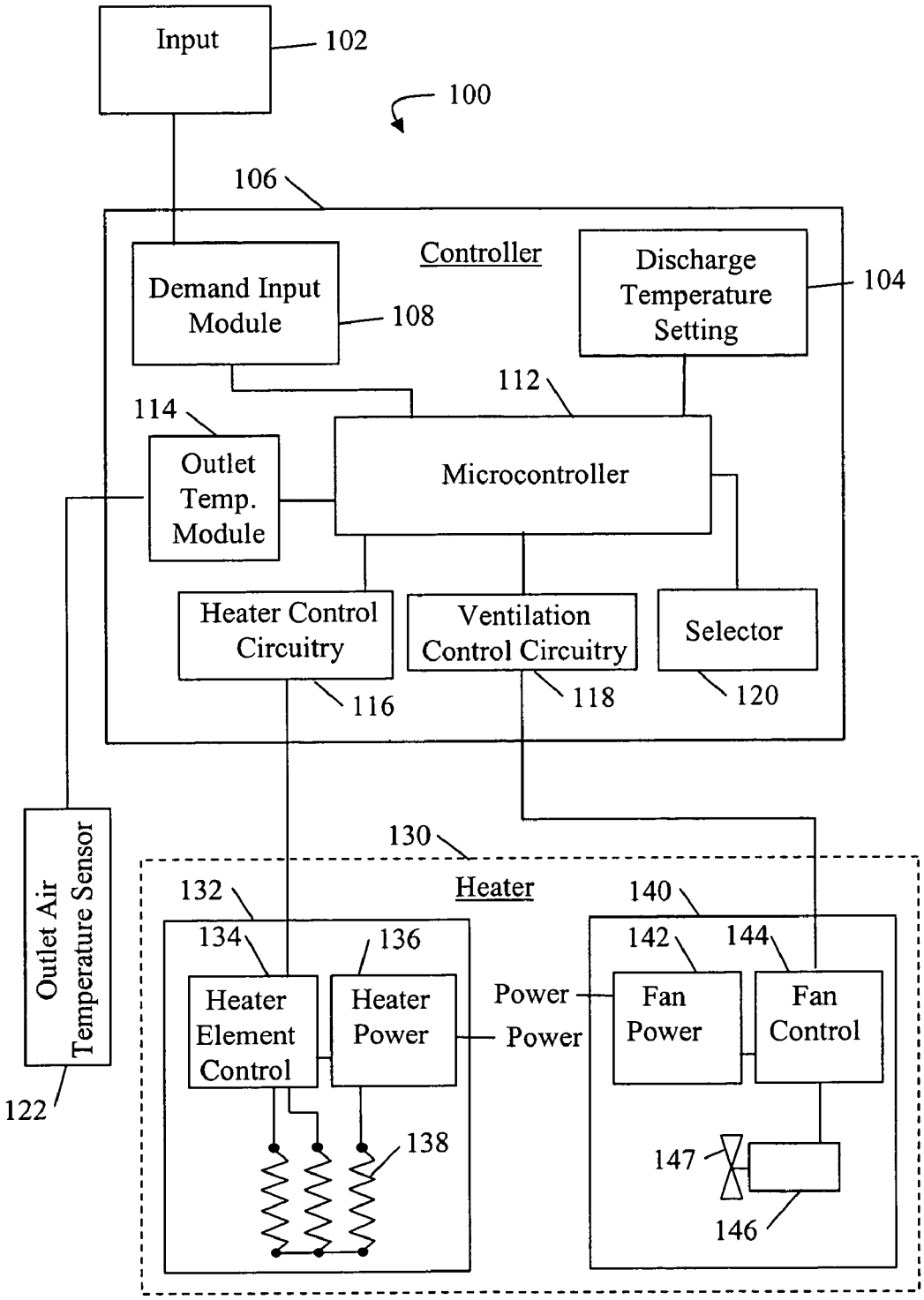
FIG. 1A is a schematic block diagram illustrating an exemplary heating and ventilating system having a controller for controlling an electric heater.

The following includes definitions of exemplary terms used throughout the disclosure. Both singular and plural forms of all terms fall within each meaning. Except where noted otherwise, capitalized and non-capitalized forms of all terms fall within each meaning:

"Circuit communication" as used herein indicates a communicative relationship between devices. Direct electrical, electromagnetic, and optical connections and indirect electrical, electromagnetic, and optical connections are examples of circuit communication. Two devices are in circuit communication if a signal from one is received by the other, regardless of whether the signal is modified by some other device. For example, two devices separated by one or more of the following-amplifiers, filters, transformers, optoisolators, digital or analog buffers, analog integrators, other electronic circuitry, fiber optic transceivers, or even satellites-are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, for example, a CPU, are in circuit communication. Also, as used herein, voltages and values representing digitized voltages are considered to be equivalent for the purposes of this application and thus the term "voltage" as used herein refers to either a signal, or a value in a processor representing a signal, or a value in a processor determined from a value representing a signal.

"Processor," may be one of virtually any number of processor systems and/or stand-alone processors, such as microprocessors, microcontrollers, and digital signal processors, and may have associated therewith, either internally therein or externally in circuit communication therewith, associated RAM, ROM, EPROM, clocks, decoders, memory controllers, and/or interrupt controllers, etc. (all not shown) known to those in the art to be needed to implement a processor circuit.

"Signal", as used herein includes, but is not limited to one or more electrical signals, analog or digital signals, one or more computer instructions, a bit or bit stream, or the like.

"Software", as used herein includes, but is not limited to one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, instructions stored in a memory, part of an operating system or other type of executable instructions. It will be appreciated by one of ordinary skill in the art that the form of software is dependent on, for example, requirements of a desired application, the environment it runs on, and/or the desires of a designer/programmer or the like.

"Logic", synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC), or other programmed logic device. Logic may also be fully embodied as software.

In the accompanying drawings which are incorporated in and constitute a part of the specification, embodiments of the invention are illustrated, which, together with a general description of the invention given above, and the detailed description given below, serve to example principles of the invention. The invention is not limited in any way to these preferred embodiments of the invention. The invention is defined broadly in the claims that are set forth after the following detailed description.

FIG. 1A illustrates an exemplary embodiment of a heating and ventilating system 100. The heating and ventilating system 100 includes a controller 106, a heater 130, an input 102 and an outlet air temperature sensor 122.

The controller 106 includes a demand input module 108, a discharge temperature setting 104, an outlet temperature module 114, heater output control circuitry 116, ventilation output control circuitry 118, and a selector 120, all in circuit communication with a processor 112. Preferably, processor 112 is a microcontroller.

The demand input module 108 receives a demand signal from input 102. Input 102 determines when there is a need for heating and/or ventilating. The determination is made by any means, such as, for example, any one or more of the following: a thermostatic setting, user input, a timing function, opening/closing of a door, a building automation system, etc. Input 102 is any device capable of communicating to the controller 106 that there is a need for heating and/or ventilating, such as, for example, a thermostat. Signals provided by the input are described in more detail below. Preferably, input 102 is placed in circuit communication with the controller 106 via a demand input module 108. Preferably, the demand input module 108 is a universal input module and is configured to accept multiple types of signals from input 102, such as, for example, any one or more of the following: an analog signal, a discrete input signal, and a three-point floating signal. Thus, demand input module 108 is universally compatible with a plurality of input devices 102.

In one exemplary embodiment, the demand input module 108 includes six terminals. The six terminals include: a "24 V" terminal and a "neutral" terminal for receiving a 24 V ac or dc discrete signal; a "signal" terminal and a "common" terminal for receiving a 0–10 V dc, a 2–10 V dc, or a 4–20 mA control sequence; and a "Increment" terminal and a "Decrement" terminal for receiving a three point floating on/off sequence, a 2-stage sequence, or a binary sequence. Thus, in this exemplary embodiment, the demand input module 108 is configured to receive demand signals from a plurality of types of inputs 102, preferably a device that provides an analog signal, and/or an input device that provides a discrete signal, and/or an input device that provides a three point floating signal.

As described above, preferably, demand input module 108 includes hardware that accepts an analog input, such as a single analog input of 0–10 V dc, 2–10 V dc and/or 4–20 mA signals. Analog inputs provide a proportional call for heat. For example in a 0–10 V dc control system, 5 V may indicate a call for 50% heat output, and 7 V may indicate a call for 70% heat output. Analog inputs can be provided by any type of input 103 such as for example a building automation system. The analog inputs can be used with any system or method for continuous heat output. Exemplary heater control methods include pulse width modulation (PWM) described in more detail below with reference to FIG. 1B, pulse position modulating (PPM), described in more detail below with reference to FIG. 1C.

Figure 1B:
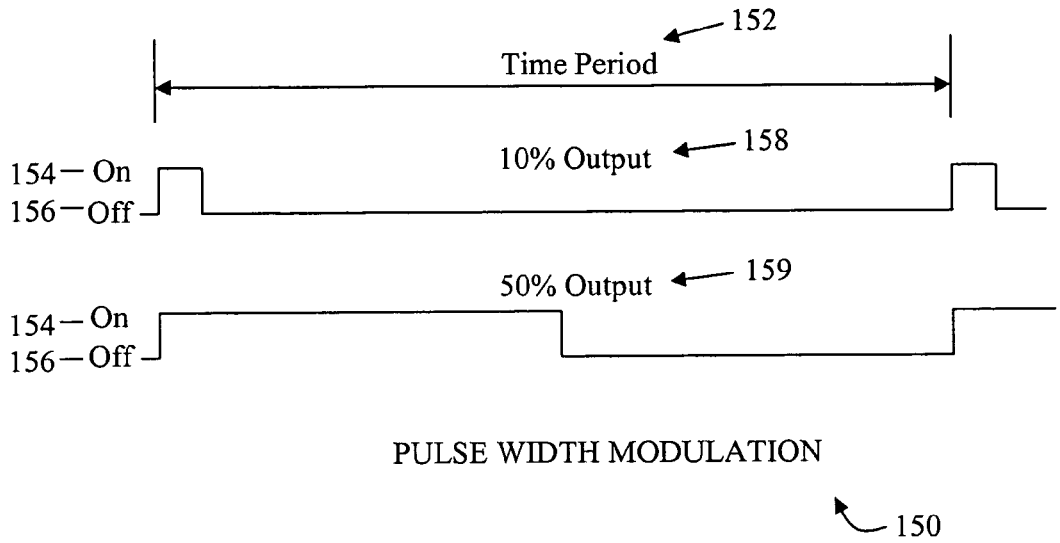
FIG. 1B is an exemplary timing diagram of a pulse width modulation system.

FIG. 1B is an exemplary pulse width modulation (PWM) system timing diagram 150 for controlling heat output. In a PWM system a constant time period 152 is established, such as, for example 10 seconds. The output is either "on" 154, or "off" 156 during the time period 152. The heating elements are preferably energized when the output is "on" 154, and de-energized when the output is "off" 156. The output is turned "on" once and turned "off" once during each time period 152 of a PWM system. The amount of heat output by the heater is proportional to the "on" time divided by the time period. A 10% heat output 158 is achieved by, for example, an "on" time 154 of 1 second. (1sec/10sec×100%=10%). Similarly, a 50% heat output 159 is achieved by, for example, a 5 second "on" 154 time over the time period 152. (5/10×100=50%).

Figure 1C:
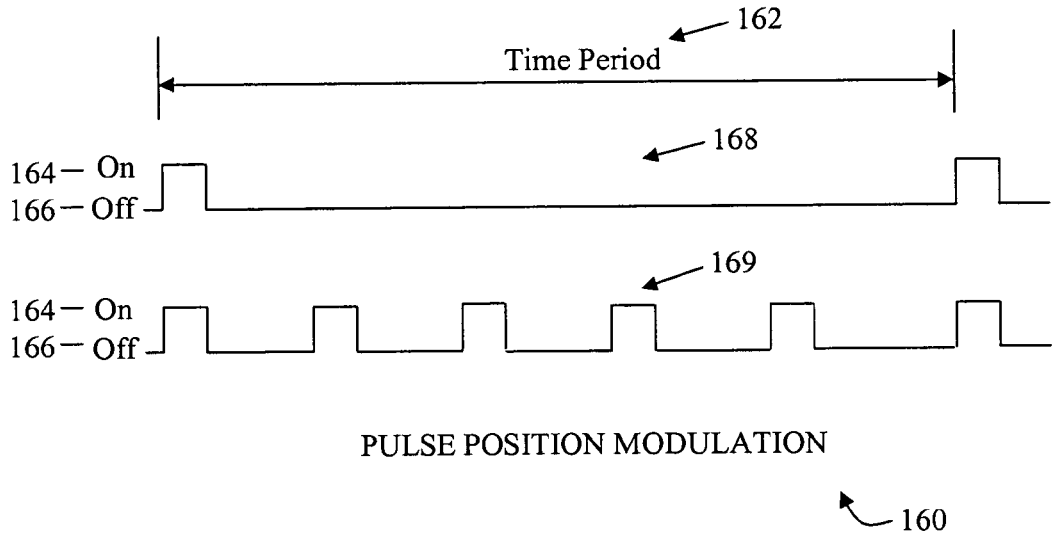
FIG. 1C is an exemplary timing diagram of a pulse position modulation system.

FIG. 1C is an exemplary pulse position modulation (PPM) system timing diagram 160 for controlling the heat output. PPM systems use a constant "on" pulse duration such as for example 15 seconds. In addition, an overall time period 162 is set, at for example 300 seconds, which in this example is 20 times the pulse duration. The heat output is proportional to the number of "on" pulses during the time period 162. The more "on" pulses, the higher the heat output.

PPM timing diagram 168 illustrates a call for a low heat output and as a result the "on" pulse is triggered only once during the time period 162. In the exemplary example, for the overall time period 300 seconds the heating elements are energized once for 15 seconds providing a low heat output or a 5% heat output. PPM timing diagram 169 illustrates a call for a higher heat output. In this example, the heater is energized, or "on" 5 times during the overall time period. Thus, over the overall 300 seconds time period the heating elements are energized 5 times for a total of 75 seconds resulting in a 25% heat output.

Referring back to FIG. 1A, demand input module 108 preferably also includes hardware that accepts discrete inputs, such as, for example, 24 V ac/dc, that can be also used for a plurality of systems or methods for controlling heat output. Discrete inputs can be provided by, for example, any one or more of the following: thermostatic, building automation systems, two-stage and binary heating methods.

Thermostatic heating control systems and methods typically use one input and cycle between "on" for a call, or signal, for heat and "off" when there is no call, or signal, for heat. Preferably, to reduce occupant awareness of this type of heating cycle the heater soft starts and soft stops. A call for heat initiates a soft start that increments the heater output and air velocity over a set time frame eliminating a cold blast of air. Similarly, when the call for heat is eliminated, the air velocity is decremented down to zero over a period of time. Allowing the system to be more efficient by capturing the heat that remains in the heating element after the heating element has been shut off.

Two-stage heating systems and methods typically use two inputs. For example, a call for stage one heat, indicated by a signal on the first input, sets the output to, for example, 50% of the maximum set limit. A call for stage two heat indicated by a signal on the second input, or alternatively by a call on both the first and second inputs sets the heat output to the maximum set outlet temperature.

Similarly, binary heating methods typically use two inputs. A call, or signal, on input one initiates stage one heat, a call, or signal, on input two initiates stage two heat and a call, or signal, or both inputs one and two initiates stage three heat. In one exemplary embodiment the stages are set to a percentage of the full output, such as, for example, stage one is set to a heat output of 33% of the maximum outlet air temperature, stage two is set to a heat output of 66% of the maximum outlet air temperature and stage three is set to a heat output of 100% of the maximum outlet air temperature.

In addition, demand input module 108 preferably includes hardware that accepts a three point floating system. A three point floating system uses two inputs. One input is an increase input, and one input is a decrease input. Depending on whether or not there is a temperature sensor attached, the system floats between 0 and 100% heat (no sensor) or a no-heat air temperature and the board-set maximum duct temperature setting (with sensor attached).

In this exemplary embodiment, one input is used for an increase or increment input, and the other is used for a decrease or decrement input. A call, or signal, on the increase input increments the heater output, which is discussed in more detail below, at a rate of, for example, one percent (1%) every nine (9) seconds. Thus, the heat output floats upward until either full heat (no discharge sensor attached) or the desired maximum duct temperature (with discharge temperature sensor), is reached. A call, or signal, on the decrease input decrements the heater output at a rate of, for example, one percent (1%) every nine (9) seconds. Thus, the heat output floats downward until either no heat (no discharge sensor attached), or the duct no-heat temperature (with discharge temperature sensor) is reached. Thus, the system continually floats between the two control points.

The demand input module 108 receives the demand signal and communicates the demand signal to the microcontroller 112 for processing. Preferably, the controller 106 also includes a discharge temperature setting 104 that provides the microcontroller 112 with the maximum outlet temperature set point, or high limit set point. The discharge temperature setting 104 includes any means of communicating the maximum desired output temperature to the microcontroller 112. Optionally, the maximum output temperature set point is set in the software or logic and, as a result, the maximum outlet temperature is factory set, or selected. Preferably, however, the maximum outlet temperature set point is selectable by the user and still more preferable is user selectable in the range of about 72° F. to 120° F. In one embodiment, the discharge temperature setting 104 includes a rotatable setting dial (not shown), wherein the maximum temperature set point is selected by rotating a temperature setting dial to a position between a lower limit and an upper limit. The selected maximum temperature set point is communicated to the microcontroller 108, and the maximum temperature set point may be used to control the heating and ventilating system.

In addition, preferably the controller 106 includes a selector 120. Selector 120 is in circuit communication with the microcontroller 112. Selector 120 is used to select a type of heat demand signal, such as, for example, binary, two-stage, PWM, thermostatic, 2–10 V, 0–10 V, 4–20 mA, and three point floating. Selector 120 is any type of selector, such as, for example, a rotatable setting dial. Preferably, however, the selector 120 includes a board with pins configured to allow the placement of jumpers, wherein placing the jumpers in different positions is a means of selecting the desired type of heat demand signal. Rotatable setting dials, switches and jumpers, however, are easily tampered with, thus optionally, the heat demand signal can be permanently set once, or optionally set in the software or logic. In addition, selector 120 can be a separate component as illustrated, or optionally selector 120 is in direct circuit communication with, or even integrated into demand input module 108.

Optionally, controller 106 includes an outlet temperature module 114. Outlet temperature module 114 is configured to receive a signal from an outlet air temperature sensor 122. Outlet air temperature sensor 122 may be any type of temperature sensor, such as, for example, a thermocouple. Preferably, outlet temperature module 114 is configured to communicate with a variety of different types of temperature sensors. Optionally, a specific type of temperature sensor can be selected and outlet temperature module 114 can be specific for use with that type of temperature sensor. Still yet, outlet temperature module 114 can be a pass thru device, such as, a a terminal strip and simply communicate the raw temperature signal directly to the microcontroller 112. In any event, with or without manipulation, output temperature module 114 communicates the outlet air temperature signal to the microcontroller 112.

Figure 3:
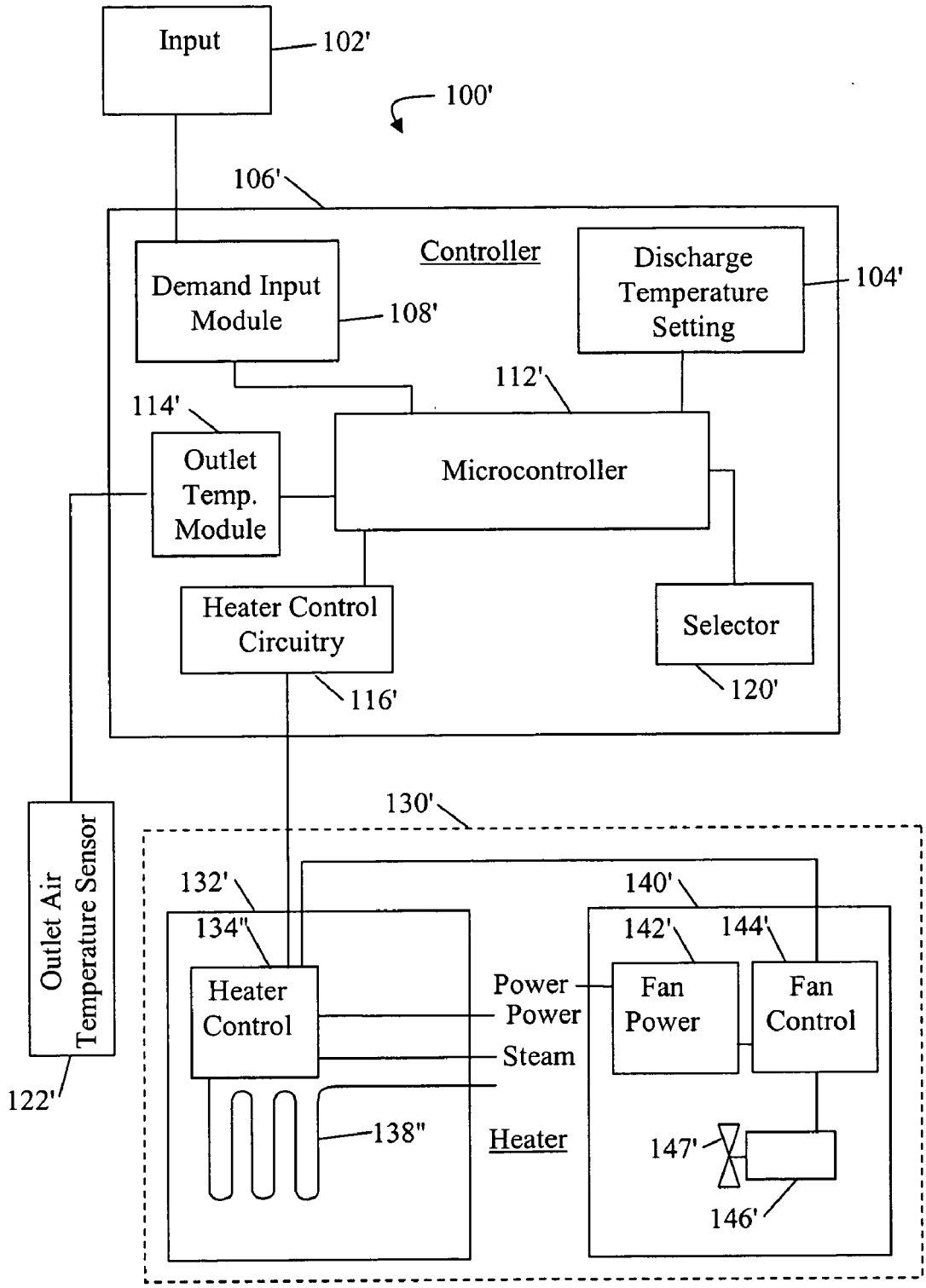
FIG. 3 is a schematic block diagram illustrating another exemplary heating and ventilating system having a controller for controlling a steam heater.
Figure 4:
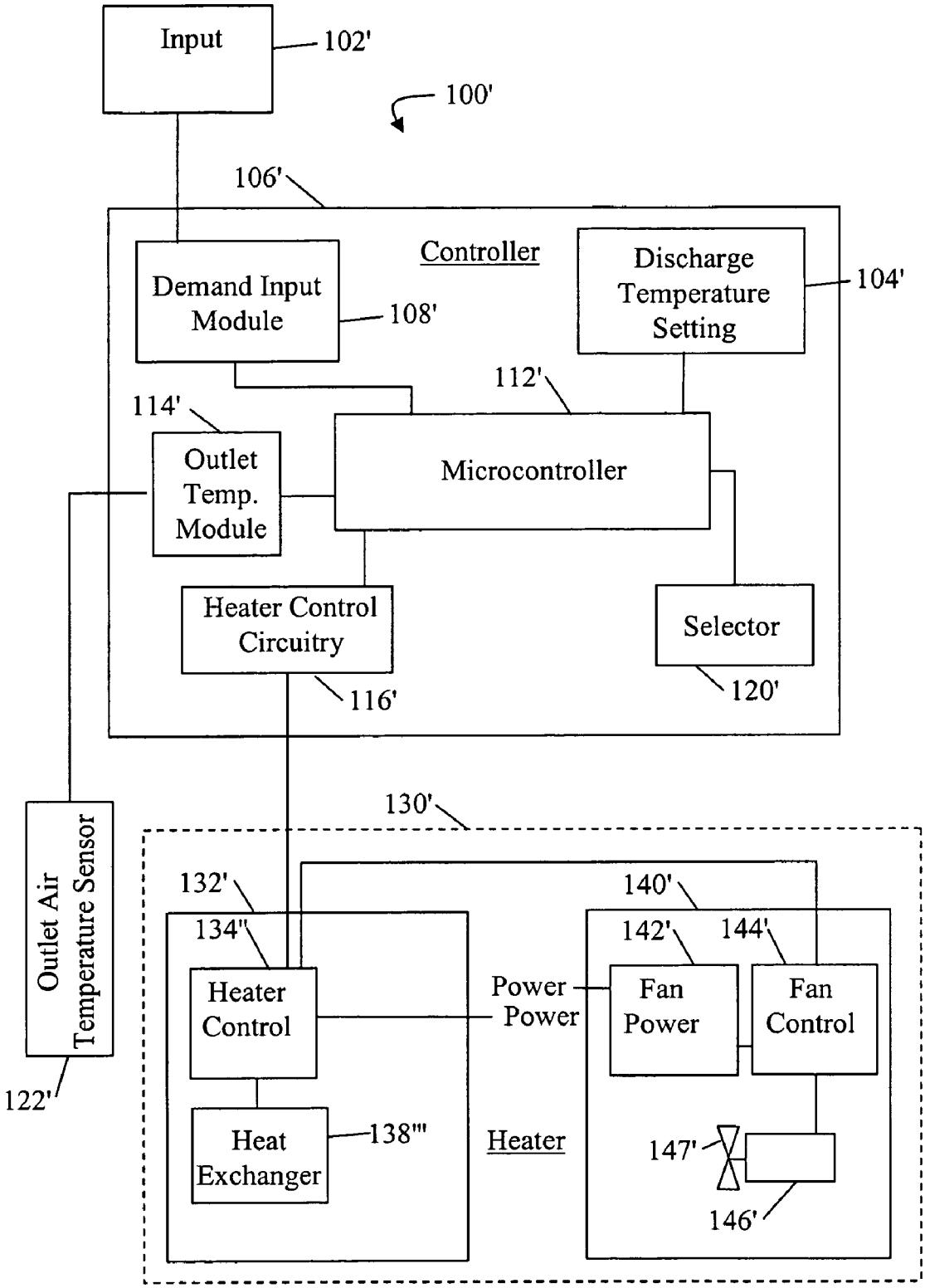
FIG. 4 is a schematic block diagram illustrating another exemplary heating and ventilating system having a controller for controlling a heat exchanger.

Heater 130 may be any type of heater, such as, for example, electric 138, 138', steam 138" (FIG. 3), hot water, or a heat exchanger 138'" (FIG. 4). Preferably, heater 130 is an electric heater, however, the system and method described herein can be easily modified or adapted for use with any type of heater. Heater 130 includes a heating portion 132 and a ventilation portion 140. The terms "blower," "fan," and "ventilator" all refer to means of creating an air flow and may be used interchangeably herein. Heater 130 has an air inlet and an air outlet, not shown. The ventilation portion 140 creates an air flow having a velocity when the motor is in operation. The air flow flows into heater 130 via the air inlet, across the heating elements 138, and out of heater 130 via the air outlet. Preferably, the air flow is generated by a variable speed motor 146 driving a fan 147. The variable speed motor 146 is used to create an air flow having a variable velocity through heater 130. The greater the speed of the variable speed motor 146, the greater the velocity of the air flow through the heater 130. Thus, the air velocity through a conduit or duct, is increased by increasing the air flow rate through the conduit or duct. Similarly, the slower the speed of the variable speed motor 146, the lower the velocity of the air flow.

The variable speed motor 146 can be any motor capable of being driven at two or more speeds, such as, for example, and electrically commutated "ECM" motor, or a permanently split capacitor "PSC" motor. The variable speed motor is controlled by the fan control 144. The fan control 144 is any means for controlling the speed of a motor, such as, for example, a variable speed controller, or a multiple speed step controller. The fan control 144 obtains a signal from ventilation control circuitry 118, which is in circuit communication with the microcontroller 112. The output from the ventilation control circuitry 118 can be any output, such as a discrete output, for use in, for example, a multiple speed step controller, or a 4–20 mA signal for use in, for example, a variable speed drive. The ventilation control circuitry 118 provides a means for controlling the velocity of the air flow through the heater 130. Thus, the fan control 144 is in circuit communication with the microcontroller 112.

Finally, the microcontroller 112 is in circuit communication with heater control circuitry 116. In turn, heater control circuitry 116 is in circuit communication with heater element control 134. The heater element control 134 preferably includes relays (not shown) for energizing the heating elements. Preferably, solid state relays are used as they are quiet, and allow rapid cycling of the heaters. Preferably, the heater control circuitry 116 is configured to control current solid state relays, as well as future solid state relays such as those that will use high power field effect transistors. Solid state relays and preferred for both PWM control as well as PPM control.

The heating elements can be single phase, two-phase, or three-phase. In the case of single phase heaters only one solid state relay is required. In multiphase heaters, multiple solid state relays are preferred. Preferably, heater elements 138 comprise three phase heaters and are connected in either a delta or wye configuration. The controller 106, via microcontroller 112 and heater control circuitry 116 control the solid state relays and cycle the relays on and off. In one embodiment, the controller 106 pulses the heating elements "on" and "off" in unison to modulate the heater. Preferably, pulse width modulation (PWM) is used and the controller 106 provides a brief "on" pulse time for low heat requirements and provides an extended "on" pulse time for higher heat requirements. Briefly pulsing the heating elements 138 "on" prevents the heating elements 138 from achieving full operating temperature when the call for heat is low.

Alternatively, pulse position modulation (PPM) is used and the heating elements 138 are fully energized, or turned "on" and then are turned "off" for a set period of time. The more time the heat elements are turned "on" during a set time period, the higher the heat output. Additional methods of controlling the heating elements can be used and are within the spirit and scope of the present invention.

In one embodiment, the heating elements 138 are pulsed on at a constant rate, using a pulse with modulation (PWM) method. As described above, in relation to FIG. 1B, PWM varies the length of time the heating elements 138 are "on", or energized, for a set time period, which is proportional to the amount of heat desired. That is, varying the duration of the "on" time or pulse time, for each time period varies the heat produced by the heater. Thus as described above, for example, if the time period is 10 seconds, the "on" time is adjusted to be proportional to the desired heat output. In the event of a desired low temperature heat output, the "on" pulse time is, for example, 100 milliseconds, over the 10 second time period. If a higher temperature output is desired the "on" pulse time is, for example, 500 milliseconds for the 10 second time period.

Alternatively, pulse position modulation (PPM) can be used. As described in relation to FIG. 1C, PPM uses a constant "on" pulse time duration every time the heating element is energized. The more "on" pulse times during the time period, the higher the heat output. The constant pulse time or "on" duration can be determined based on, for example, the time the heating element needs to reach operating temperature. For example, if the heating elements require 15 seconds to reach full operating temperature the "on" duration can be set to 15 seconds. A time period can be set to, for example, 20 times the required time to reach operating temperature. In this example, 20 times 15 seconds provides a time period of 300 seconds, or 5 minutes. Using PPM, the "on" pulse time is constant, 15 seconds. A low temperature setting is reached by fewer "on" pulses during the set time period, while a higher temperature setting is reached a higher number of "on" times per time period.

Figure 1D:
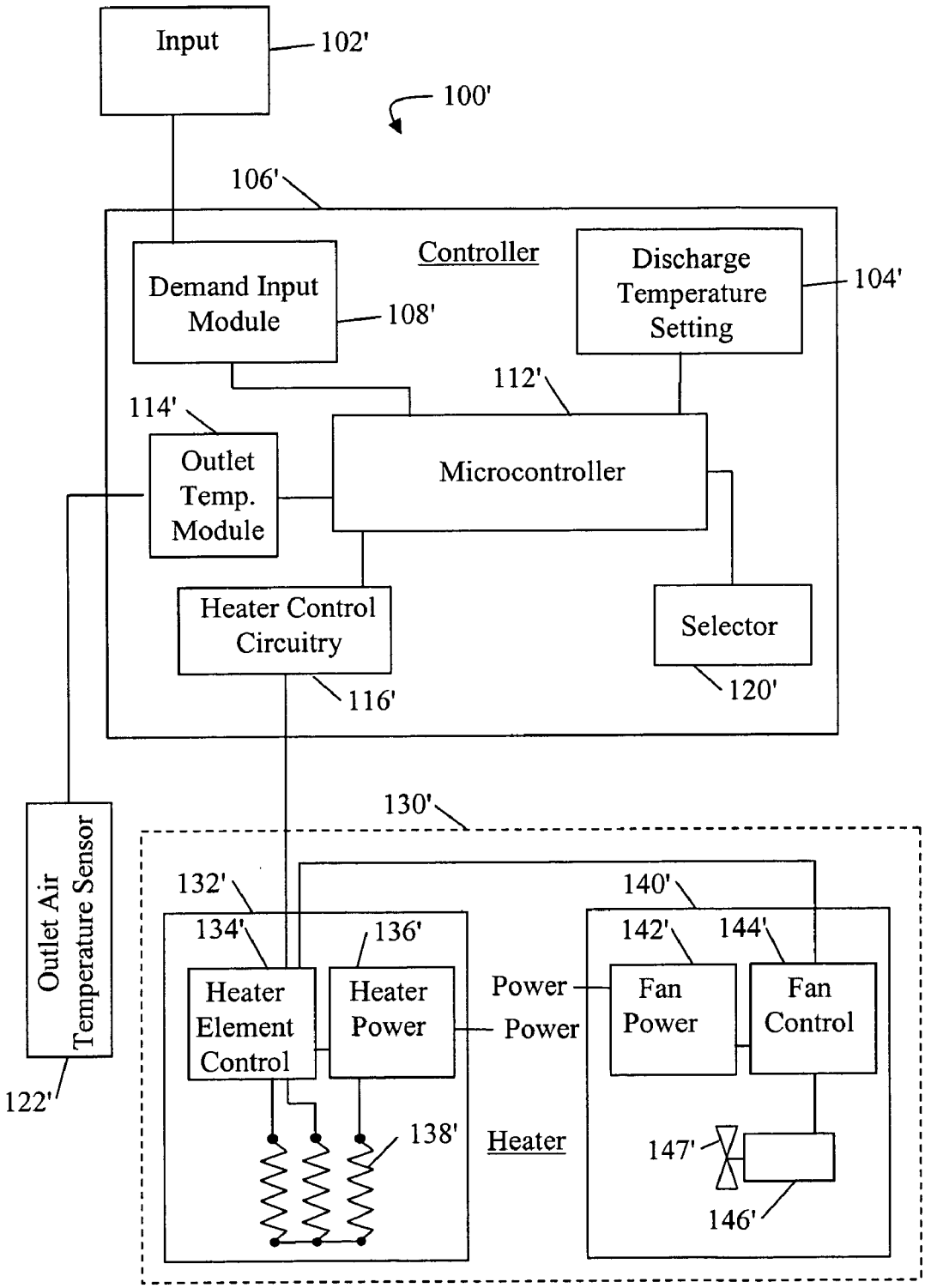
FIG. 1D is a schematic block diagram illustrating another exemplary heating and ventilating system having a controller for controlling an electric heater.

FIG. 1D illustrates another exemplary embodiment of a heating and ventilating system 100'. The heating and ventilating system 100' is similar to heating and ventilating system 100, and includes a controller 106', a heater 130', an input 102' and an outlet air temperature sensor 122'. The "'" after the number is used to indicate components that are similar to those described above. The components may or may not need be modified in order to perform the functions necessary to implement heating and ventilating system 100'.

In this exemplary embodiment, controller 106' includes a demand input module 108', a discharge temperature setting 104', an outlet temperature module 114', heater control circuitry 116' and a demand input selector 120'. Controller 106' is substantially similar to controller 106 with the exception that controller 106' does not vary the velocity of the air flow rate or control the air flow velocity.

The fan 147' and fan motor 146' can be controlled by the heater controller, by for example, having the fan motor energize before the heating elements 138' are energized. This can be accomplished by, for example, using a "delay on" relay for the heating elements. Optionally, controller 106' includes ventilation control circuitry (not shown) to initiate the air flow. Preferably, controller 106' does not control, or vary the speed of the motor 146 as a function of the outlet temperature. Other elements in the circuit function in substantially the same way as described above.

In this exemplary embodiment, the controller 106' controls the heat output generated by the heating elements 138'. Similarly to that described above, the controller 106' receives a demand for heat from input 102'. The controller 106' turns on heater 130' and initiates heat output. The controller 106' receives a signal indicative of the outlet air temperature from outlet air temperature sensor 122'. The controller 106' compares the outlet air temperature to a maximum discharge temperature obtained from, for example, discharge temperature setting 104', or from, for example, a programmed value stored in memory. The controller 106' controls the upper limits of the heat output generated by the heating elements 138' as a function of the outlet air temperature. Thus, if the outlet temperature has reached at its maximum outlet temperature, no increase in heat output by the heating elements 138' is called for by the controller 106'. Limiting the maximum outlet temperature lessens the likelihood of some common problems, such as, for example, air stratification because the discharge temperature does not get too high. Upon satisfying the heat demand, or upon reaching a maximum run time, controller 106' initiates a shut down of heating elements 138'.

Figure 2A:
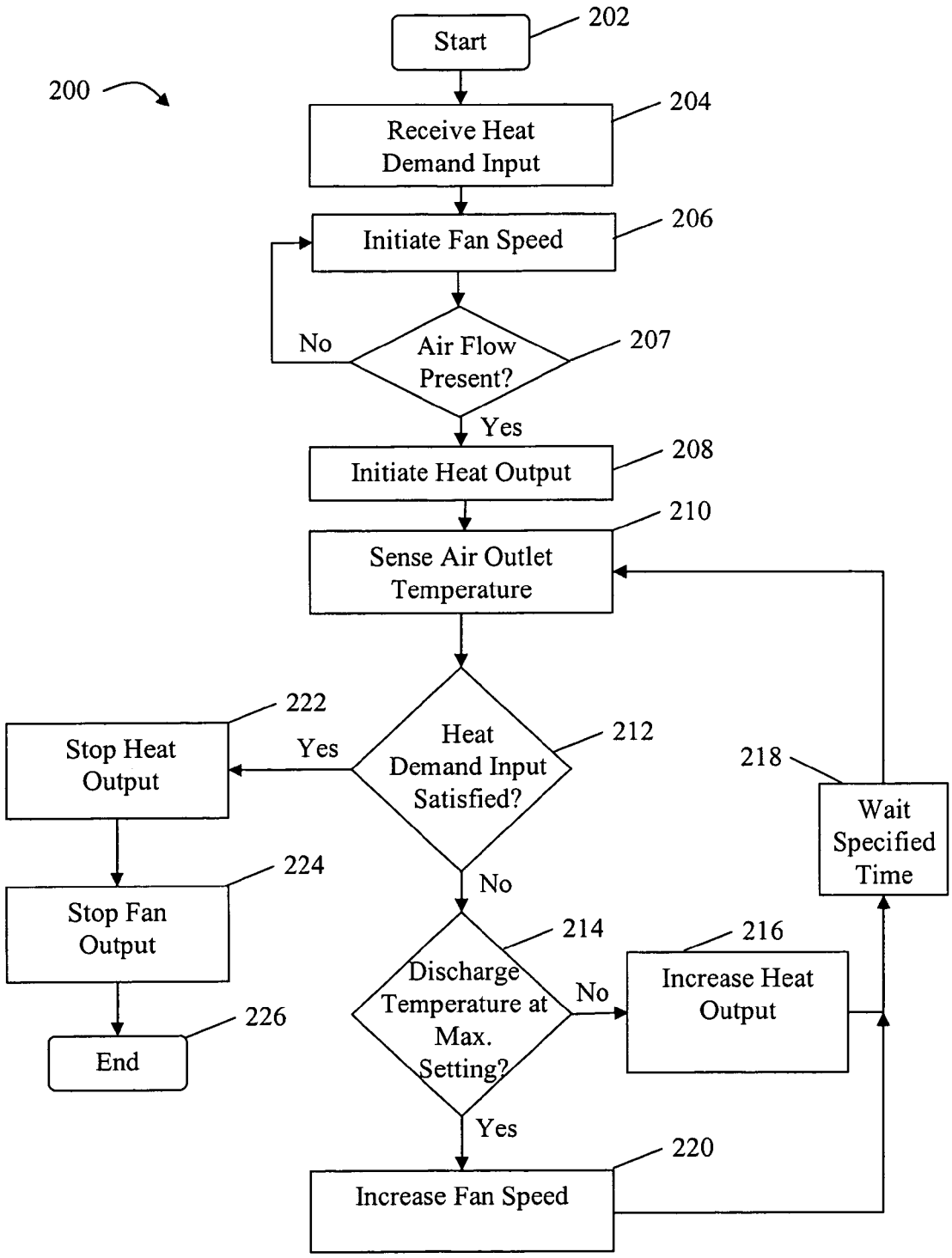
FIG. 2A is a flow diagram for an exemplary heating and ventilating controller.

FIG. 2A illustrates an exemplary methodology of controlling a heating and ventilating system 200. As illustrated, the blocks represent functions, actions and/or events performed therein. It will be appreciated that electronic logic and software applications involve dynamic and flexible processes such that the illustrated blocks can be performed in other sequences different than the one shown. Elements embodied as software may be implemented using various programming approaches such as machine language, procedural, object oriented, artificial intelligence techniques or other techniques. In addition, if desired and appropriate, some or all of the software or logic can be embodied as part of a device's operating system.

The methodology begins at block 202. At block 204 a heat demand signal is received by the controller. The controller energizes the fan or blower motor to an initial speed. Preferably, the initial speed is selected to create the minimum required air flow velocity. Optionally, the initial fan speed can be set at a lower velocity and ramped up to the minimum velocity while the heating elements are heating up. Thus, providing a soft start and reducing an initial blast of cold air when the system starts. At block 207 the controller determines whether the minimum air flow velocity is present. This determination can be accomplished by, for example, monitoring the fan speed, monitoring a vacuum switch, or an air flow interlock. If no air flow velocity is present, the controller either continues to energize the fan or blower motor, or in the alternative, outputs an error message to, for example, a display or to a building automation system.

If at block 207 the controller determines the minimum air flow velocity is present the controller initiates a heat output to the heating element at block 208. The heat output is determined by the heater control circuitry, which is preferably controlled by a processor. In one embodiment, the processor includes PWM logic that modulates the heater "on time" for each pulse rate to control the heat output. In another embodiment, the processor includes PPM logic, which has a constant "on time" and varies the "off time" to achieve a desired heating temperature. The controller determines the air outlet temperature at block 210 by receiving a signal that corresponds to a temperature received from the outlet air temperature sensor. At block 212 the controller examines the heat demand input signal and determines whether or not a demand, or signal, for additional heat is present.

If the heat demand is not satisfied at block 212, that is a demand for additional heat is present, the method proceeds to block 214. At block 214 the discharge air temperature that was determined at block 210 is compared to the maximum discharge air temperature set point. Preferably, the maximum discharge air temperature set point is selected by a user. More preferably, the selected set point is between about 72° F. and 120° F. If the maximum discharge temperature setting has not been reached, the controller increases the heat output at block 216. The controller can increase the heat output by for example, increasing the "on time" for the cycle in a PWM system. In another embodiment, the controller can increase the heat output by decreasing the "off time" (i.e. increasing the number of "on" times per time period) in a PPM system. Upon increasing the heat output, and the methodology progresses to block 218. If at block 214 the maximum discharge temperature has been met the controller increments the fan speed a set amount at block 220 and continues to block 218. At block 218 the controller waits for a period of time, allowing the system to stabilize with the adjusted fan speed, or adjusted heat output. The controller again determines the air outlet temperature at block 210 and checks to see if the heat demand input is satisfied at 212. If the heat demand input is still not being satisfied at block 214, the methodology continues as described above. The methodology allows the outlet temperature to reach a maximum set point, and then if the heat demand is not met the air flow velocity is increased while at the same time the maximum outlet temperature is substantially maintained at the set temperature. This provides additional heat output without exceeding a set maximum outlet temperature.

If at block 212, the heat demand is being satisfied the controller stops initiating heat output at block 222. The controller de-energizes the fan output at block 224. The fan output can be immediately de-energized, however, preferably the fan speed output is ramped down slowly, thereby increasing the efficiency of the heater by extracting all of the heat generated by the heating elements. The heating cycle ends at block 226.

Figure 2B:
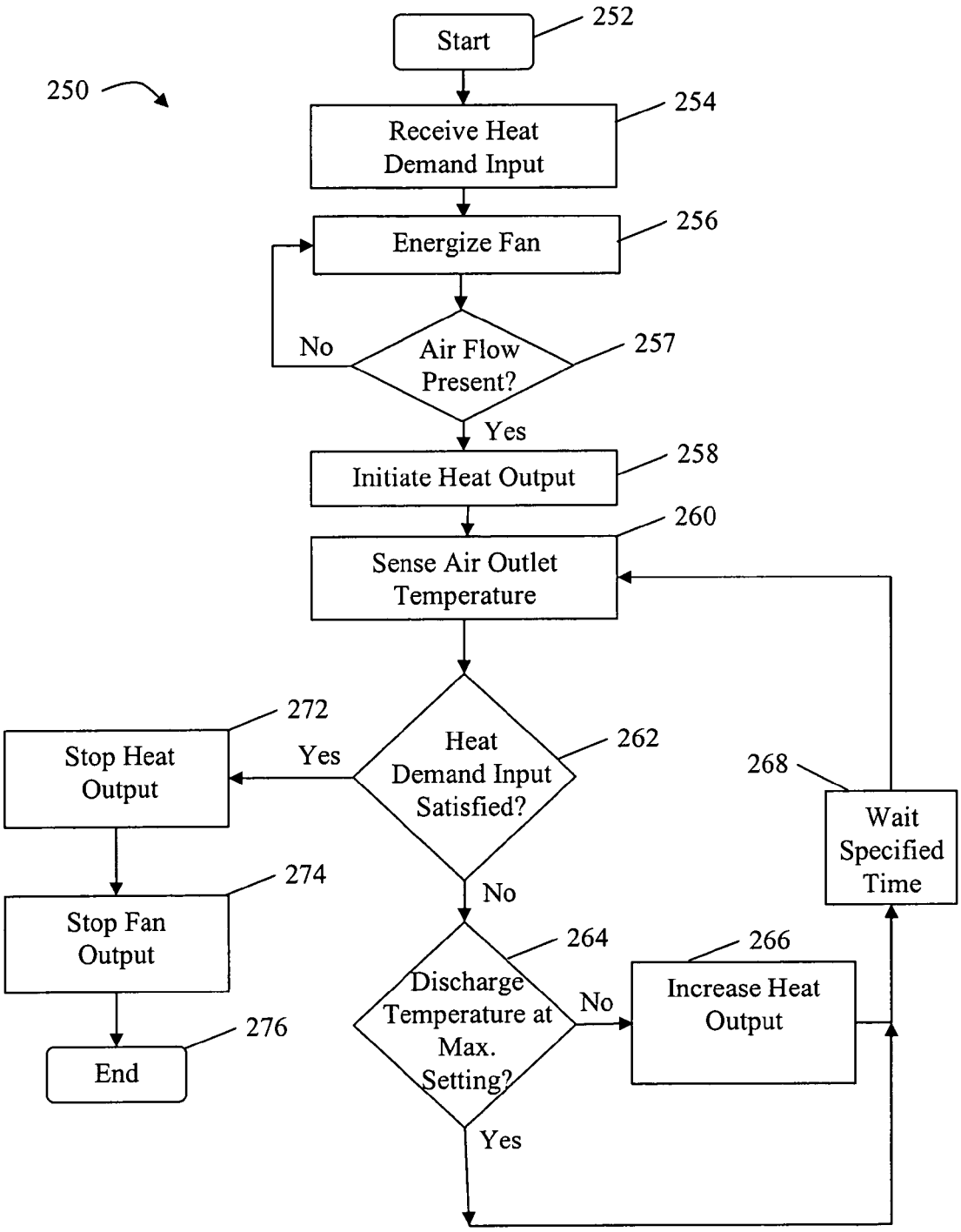
FIG. 2B is a flow diagram for another exemplary heating and ventilating controller.

FIG. 2B illustrates an exemplary methodology of controlling a heating and ventilating system 250. As illustrated, the blocks represent functions, actions and/or events performed therein. The electronic logic and software applications involve dynamic and flexible processes such that the illustrated blocks can be performed in other sequences different than the one shown. Elements embodied as software may be implemented using various programming approaches such as machine language, procedural, object oriented, artificial intelligence techniques or other techniques. In addition, if desired and appropriate, some or all of the software or logic can be embodied as part of a device's operating system.

The methodology begins at block 252. At block 254 a heat demand signal is received by the controller. Preferably, the fan or blower motor is energized to create an air flow. At block 257 the controller determines whether a minimum air flow velocity is present. This determination can be accomplished by, for example, monitoring the fan speed, monitoring a vacuum switch, or an air flow interlock. Optionally, the heater 130' contains an interlock that does not allow the heating elements 138' to energize if no air flow velocity is present. If no air flow velocity is present, preferably an error message is output to, for example, a display or to a building automation system.

If at block 257 the controller determines the minimum air flow velocity is present the controller initiates a heat output to the heating element at block 258. The amount of heat output is determined by the heater control circuitry, which is preferably controlled by a processor. In one embodiment, the processor includes PWM logic that modulates the heater "on time" for each pulse rate to control the heat output. In another embodiment, the processor includes PPM logic, which has a constant "on time" and varies the "off time" to achieve a desired heating temperature. The controller determines the air outlet temperature at block 260 by receiving a signal that corresponds to a temperature received from the outlet air temperature sensor. At block 262 the controller examines the heat demand input signal and determines whether or not a demand, or signal, for additional heat is present.

If the heat demand is not satisfied at block 262, that is a demand for additional heat is present, the method proceeds to block 264. At block 264 the discharge air temperature that was determined at block 260 is compared to the maximum discharge air temperature set point. Preferably, the maximum discharge air temperature set point is selected by a user. More preferably, the selected set point is between about 72° F. and 120° F. If the maximum discharge temperature setting has not been reached, the controller increases the heat output at block 266. The controller can increase the heat output by for example, increasing the "on time" for the cycle in a PWM system. In another embodiment, the controller can increase the heat output by decreasing the "off time" (i.e. increasing the number of "on" times per time period) in a PPM system. Upon increasing the heat output, and the methodology progresses to block 268. If at block 264 the maximum discharge temperature has been met the controller continues to block 268. At block 268 the controller waits for a period of time, allowing the system to stabilize with the adjusted heat output. The controller again determines the air outlet temperature at block 260 and checks to see if the heat demand input is satisfied at 262. If the heat demand input is still not being satisfied at block 264, the methodology continues as described above. This methodology allows the outlet temperature to reach a maximum set point, but not to substantially exceed the maximum set temperature.

If at block 262, the heat demand is being satisfied the controller stops initiating heat output at block 272. The controller de-energizes the fan output at block 274. The fan output can be immediately de-energized, however, preferably the fan speed output is ramped down slowly, thereby increasing the efficiency of the heater by extracting all of the heat generated by the heating elements. The heating cycle ends at block 276.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. For example multiple temperature set points can be programmed allowing the set points to be determined based upon the outside ambient air temperature. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A system for controlling heating and ventilating comprising:

a microcontroller;

a universal demand input configured for receiving a demand signal from a plurality of types of inputs;

a heater control circuit for providing a plurality of heat outputs from a heat source;

a ventilator control circuit for providing a plurality of air flow velocities from an air source; and an outlet air temperature sensor for sensing the outlet air temperature from the heat source, the demand input, heater control circuit, ventilator control circuit and outlet air temperature sensor all in circuit communication with the microcontroller.

2. The system for controlling heating and ventilating of claim 1 wherein the universal demand input is configured to accept an analog signal, a discrete input, and a three point floating signal.

3. The system for controlling heating and ventilating of claim 1 wherein the universal demand input is configured to accept an analog signal and a three point floating signal.

4. The system for controlling heating and ventilating of claim 1 wherein one of the plurality of types of inputs is an analog signal.

5. The system for controlling heating and ventilating of claim 1 wherein one of the plurality of types of inputs is a discrete input.

6. The system for controlling heating and ventilating of claim 1 wherein one of the plurality of types of inputs is a three point floating signal.

7. The system for controlling heating and ventilating of claim 1 further comprising a set point input in circuit communication with the microcontroller for setting the maximum outlet air temperature set point.

8. The system for controlling heating and ventilating of claim 7 further comprising heating logic to increase the heat output from the heat source until there is no demand signal or the maximum outlet air temperature set point is reached.

9. The system for controlling heating and ventilating of claim 8 wherein the heating logic comprises one selected from PPM logic or PWM logic.

10. The system for controlling heating and ventilating of claim 8 further comprising increase air flow logic to increase the air flow from an air source while substantially maintaining the maximum outlet air temperature set point.

11. A heating and ventilating system for at least partially heating and ventilating a building comprising:

an air inlet;

an air outlet;

a heating element located between the air inlet and the air outlet for providing a plurality of heat outputs and having a sufficient heating output to at least partially heat a building;

a fan for generating a plurality of air flow velocities from the air inlet to the outlet, the air flow velocities sufficient to circulate air throughout at least a portion of a building;

a sensor for sensing air temperature from the air outlet;

a first input for receiving a heat demand signal;

a second input for setting a maximum outlet air temperature; and a controller configured to adjust a heat output generated by the heating element and to adjust the air flow velocities generated by the fan.

12. The heating and ventilating system of claim 11 further comprising heat output logic to increase the heat output of the heating element up to about a set maximum outlet air temperature.

13. The heating and ventilating system of claim 12 wherein heat output logic comprises time proportioning logic for controlling the heat output.

14. The heating and ventilating system of claim 11 further comprising air flow output logic to increase the air flow while substantially maintaining the set maximum outlet air temperature.

15. The heating and ventilating system of claim 11 wherein the heating element comprises one or more electrical elements.

16. A system for controlling heating and ventilating comprising:

a microcontroller;

a demand input for receiving a demand signal;

a heater control circuit for providing a plurality of heat outputs from a heat source;

a ventilator control circuit for providing a plurality of air flow velocities from an air source; and an outlet air temperature sensor for sensing the outlet air temperature from the heat source, the demand input, heater control circuit, ventilator control circuit and outlet air temperature sensor all in circuit communication with the microcontroller;

a set point input in circuit communication with the microcontroller for setting the maximum outlet air temperature set point; and heating logic to increase the heat output from the heat source until there is no demand signal or the maximum outlet air temperature set point is reached.

17. The system for controlling heating and ventilating of claim 16 wherein the demand input is configured to accept an analog signal, a discrete input, and a three point floating signal.

18. The system for controlling heating and ventilating of claim 16 wherein the demand input is configured to accept an analog signal and a three point floating signal.

19. The system for controlling heating and ventilating of claim 16 wherein the demand input is configured to receive an analog signal.

20. The system for controlling heating and ventilating of claim 16 wherein the demand input is configured to receive a discrete input.

21. The system for controlling heating and ventilating of claim 16 wherein the demand input is configured to receive a three point floating signal.

22. A system for controlling heating and ventilating comprising:

a microcontroller;

a demand input for receiving a demand signal;

a heater control circuit for providing a plurality of heat outputs from a heat source;

a ventilator control circuit for providing a plurality of air flow velocities from an air source; and an outlet air temperature sensor for sensing the outlet air temperature from the heat source, the demand input, heater control circuit, ventilator control circuit and outlet air temperature sensor all in circuit communication with the microcontroller;

a set point input in circuit communication with the microcontroller for setting the maximum outlet air temperature set point; and increase air flow logic to increase the air flow from an air source while substantially maintaining the maximum outlet air temperature set point.

23. The system for controlling heating and ventilating of claim 22 wherein the demand input is configured to accept an analog signal, a discrete input, and a three point floating signal.

24. The system for controlling heating and ventilating of claim 22 wherein the demand input is configured to accept an analog signal and a three point floating signal.

25. The system for controlling heating and ventilating of claim 22 wherein the demand input is configured to receive an analog signal.

26. The system for controlling heating and ventilating of claim 22 wherein the demand input is configured to receive a discrete input.

27. The system for controlling heating and ventilating of claim 22 wherein the demand input is configured to receive a three point floating signal.

28. A system for controlling heating and ventilating comprising:

a microcontroller;

a demand input for receiving a demand signal;

a heater control circuit for providing a plurality of heat outputs from a heat source;

a ventilator control circuit for providing a plurality of air flow velocities from an air source; and an outlet air temperature sensor for sensing the outlet air temperature from the heat source, the demand input, heater control circuit, ventilator control circuit and outlet air temperature sensor all in circuit communication with the microcontroller;

a set point input in circuit communication with the microcontroller for setting the maximum outlet air temperature set point;

heating logic to increase the heat output from the heat source until there is no demand signal or the maximum outlet air temperature set point is reached; and increase air flow logic to increase the air flow from an air source while substantially maintaining the maximum outlet air temperature set point.

29. The system for controlling heating and ventilating of claim 28 wherein the demand input is configured to accept an analog signal, a discrete input, and a three point floating signal.

30. The system for controlling heating and ventilating of claim 28 wherein the demand input is configured to accept an analog signal and a three point floating signal.

31. The system for controlling heating and ventilating of claim 28 wherein the demand input is configured to receive an analog signal.

32. The system for controlling heating and ventilating of claim 28 wherein the demand input is configured to receive a discrete input.

33. The system for controlling heating and ventilating of claim 28 wherein the demand input is configured to receive a three point floating signal.

* * * * *